US009802634B2

(12) United States Patent
Lehnertz

(10) Patent No.: US 9,802,634 B2
(45) Date of Patent: Oct. 31, 2017

(54) DEVICE FOR TRAFFIC-DEPENDENT CONTROL OF BARRIERS AND LIGHT SIGNALS AT A GRADE CROSSING

(71) Applicant: Robert Bosch GmbH, Stuttgart (DE)

(72) Inventor: Benedikt Lehnertz, Ludwigsburg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 176 days.

(21) Appl. No.: 14/703,520

(22) Filed: May 4, 2015

(65) Prior Publication Data

US 2015/0321684 A1 Nov. 12, 2015

(30) Foreign Application Priority Data

May 7, 2014 (DE) ..... 10 2014 208 528

(51) Int. Cl.
*B61L 29/28* (2006.01)
*B61L 29/22* (2006.01)
*B61L 23/04* (2006.01)

(52) U.S. Cl.
CPC ..... *B61L 29/28* (2013.01); *B61L 23/041* (2013.01); *B61L 29/22* (2013.01)

(58) Field of Classification Search
CPC ..... B61L 29/00; B61L 29/02; B61L 29/023; B61L 29/04; B61L 29/08; B61L 29/18; B61L 29/22; B61L 29/24
See application file for complete search history.

(56) References Cited

U.S. PATENT DOCUMENTS

2012/0286103 A1* 11/2012 Hilleary ..... B61L 23/041 246/125

FOREIGN PATENT DOCUMENTS

| | | |
|---|---|---|
| DE | 196 12 579 | 10/1997 |
| DE | 10 2006 040 542 | 3/2008 |
| DE | 10 2007 032 091 | 4/2009 |

* cited by examiner

*Primary Examiner* — R. J. McCarry, Jr.

(74) *Attorney, Agent, or Firm* — Norton Rose Fulbright US LLP; Gerard Messina

(57) ABSTRACT

In a method for traffic-dependent output of a control signal for at least one of a barrier and a traffic light signal at a grade crossing, a radar sensor device detects motions of traffic objects over a street traffic area of the grade crossing, a control signal is emitted to a control unit for the barrier and/or for the traffic light signal situated on the inflow side of the grade crossing, using a lead time before an expected time of arrival of a train at the grade crossing, and the lead time is determined with the aid of a curve over time of the detected motions of the traffic objects, the lead time for a slow-moving traffic being greater than for a more rapidly flowing, unimpeded traffic.

12 Claims, 8 Drawing Sheets

DEVICE FOR TRAFFIC-DEPENDENT CONTROL OF BARRIERS AND LIGHT SIGNALS AT A GRADE CROSSING

BACKGROUND OF THE INVENTION

1. Field of the Invention

The present invention relates to a device for controlling at least one barrier and/or at least one light signal at a grade crossing.

2. Description of the Related Art

In a conventional control of light signals at a fully barriered grade crossing, the light signals are activated so early before the expected arrival of a train, i.e. switched to red, that it is avoided with great probability, upon the subsequent closing of the full barriers, that vehicles are closed in on the grade crossing. The actuation of the light signals takes place, for example, using an established lead time before the closing of the barriers. The barriers, in turn, are closed using a specified clearance in time before the expected arrival of the train.

Published German patent application document DE 196 12 579 A1 describes a system for monitoring a danger zone, at full barrier grade crossings, having a rotating radar range finder which scans the danger zone horizontally. At the defined boundary of the danger zone, reference marking points are situated, in order to limit the scanning to the area within these marking points. Alternatively, sector elements of the danger zone may be stored according to length and angle, and the scanning of the danger zone using electronic means may be limited to the stored sector elements. The closing of the barriers is prevented if an object of a certain size, for instance, a vehicle or a person is located on the roadway surface in the danger zone of the grade crossing.

BRIEF SUMMARY OF THE INVENTION

In the conventional actuation of light signals at a fully barriered grade crossing, the light signals are switched to red in good time, independently of the current traffic situation on the grade crossing. This early, traffic-independent switching may lead to an impairment of the traffic flow. In the case of a crossing near the grade crossing, besides the street crossing the grade crossing, a neighboring street may also be affected by a backup.

It is therefore the object of the present invention to create a device for the traffic-dependent control of a barrier and/or a light signal at a grade crossing, which is able to reduce or avoid the disadvantages of the related art.

According to the present invention, this object is attained by a device for the traffic-dependent control of at least one barrier and/or at least one light signal at a grade crossing, having a radar sensor device which is set up to detect the motions of traffic objects over a street traffic area, and having an evaluation unit which is set up to emit a control signal to a control unit for a barrier and/or for a street traffic light signal situated at the inflow side of the grade crossing having a lead time before an expected time of the arrival of a train at the grade crossing; and to determine the lead time with the aid of the course over time of the detected motions of the traffic objects, the lead time during slow-moving traffic being greater than at speedily flowing, unimpeded traffic.

Consequently, the lead time at which, for instance, a light signal is switched to red, that is, a red luminous signal, particularly a red blinking signal, is switched on will be adapted to the observed traffic. In particular, an adaptation may take place to an anticipated time required for the traffic to flow away from the grade crossing.

At a greater lead time, the point in time of emitting the control signal is advanced in time, i.e. the control signal is emitted earlier.

The present invention has the advantage that, when the traffic is flowing unimpeded, by the determination of a shorter lead time, an unnecessary backup in front of the grade crossing may be avoided and the traffic flow may be improved overall. In particular, the waiting time ahead of the grade crossing may be decreased. On the other hand, in the case of a current traffic situation in which the traffic flows only slowly, for instance, in stagnating traffic or a traffic jam, a long lead time may be selected deliberately. Because of an increased lead time, it may be better made certain that the grade crossing, especially the danger zone, is cleared in time before the arrival of the train.

The detection of motions of traffic objects may include the determination of object speeds and/or object tracking, for example. Thus, from sequences in time of object positions of the traffic objects, object trajectories may be determined, which describe the motions of the traffic objects.

The device according to the present invention may represent an auxiliary device for the control unit and/or include the control unit. The control unit is set up, based on the control signal and optionally at least one additional control signal, to control the barrier and/or the street traffic light signal, for example. The control signal may be, for example, a control signal for controlling the barrier and/or the street traffic light signal. The control signal may be a switching signal for activating the barrier and the street traffic light signal, for example. However, the control signal may also be a switching recommendation, for instance, which is emitted to the control unit.

The evaluation unit is particularly set up to emit the control signal as a function of information on an expected point in time of the arrival of a train at the grade crossing. The device may have a data receiving unit for the wireless or wire-bound reception of information on an expected time of the arrival of a train at the grade crossing.

The evaluation unit is preferably set up to determine an expected flow-off time of the traffic of the traffic objects on a route section, with the aid of the curve over time of the detected motions of the traffic objects, and to determine the lead time with the aid of the expected flow-off time, and optionally an increased factor of safety. In particular, the lead time may be adapted to the expected flow-off time, for example, optionally while taking into account the increased factor of safety.

The evaluation unit is preferably set up to emit one control signal, for each route section having a different travel direction, to a barrier assigned to the travel direction and/or to a street traffic light signal situated on the inflow side with respect to the respective travel direction, using a lead time before the broadened time of the arrival of a train at the grade crossing, and to determine the respective lead time with the aid of the curve over time of the detected motions of the objects assigned to the respective route section. In other words, the evaluation unit is set up to determine a lead time for emitting the respective control signal, for each route section having a different travel direction, to a control unit for the barrier assigned to the respective route section and/or the street traffic light signal situated on the inflow side of the grade crossing with respect to its travel direction. Because of a determination of the lead time that is individual to each lane, a further improvement of the traffic flow is made possible.

The object is further attained by a method corresponding to a described functioning of the device, particularly a method for the traffic-dependent output of a control signal for at least one barrier and/or at least one light signal at a grade crossing, while using location data of at least one radar sensor device that is situated stationary with respect to a street traffic area, having the steps:

detecting motions of traffic objects over the street traffic area;

determining a lead time with the aid of the curve over time of the detected motions of the traffic objects over the street traffic area, the lead time during slow-moving traffic being set to a greater value than in the case of rapidly flowing, unimpeded traffic; and emitting a control signal to a control unit for a barrier and/or for a street traffic light signal situated on the inflow side of the grade crossing, using the determined lead time before an expected time of the arrival of a train at the grade crossing.

The method may include, for example:

ascertaining object trajectories from sequences over time of the object positions of traffic objects (30) moving over street traffic area (20) and recorded by the at least one radar sensor device (10);

identifying the position of at least one traffic path (40; 42; 44; 46) with the aid of an accumulation (36) of object trajectories (34), and assigning respective traffic objects (30) recorded by the at least one radar sensor device (10) to a respective traffic path (40; 42; 44; 46), whose position was identified.

DETAILED DESCRIPTION OF THE INVENTION

Figure 1:
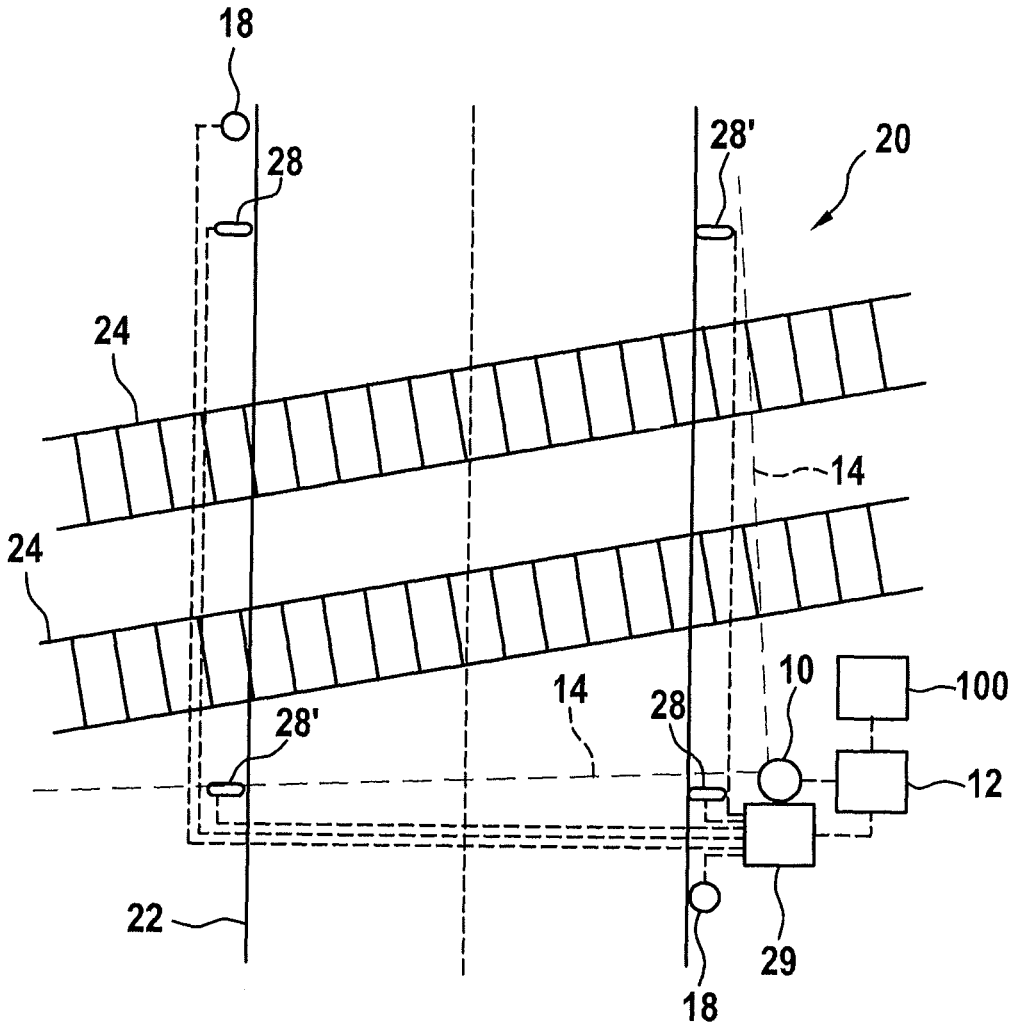
FIG. 1 shows a schematic top view onto a grade crossing having a device according to the present invention, for the traffic-dependent control of barriers and light signals.

FIG. 1 schematically shows a radar sensor device in the form of a radar sensor 10 and an evaluation unit 12 that is connected to it or integrated into it. Radar sensor 10 is an FMCW radar sensor having a send/receive device, which includes a patch antenna array. It has a schematically shown field of view 14, which includes an azimuth angle range of at least 90°, preferably at least 160°. A plurality of antenna elements are situated horizontally offset with respect to one another.

Radar sensor 10 is situated at the edge of a street traffic area 20, which is included in field of view 14. Street traffic area 20 includes a street 22 which crosses a railroad having tracks 24 at the level crossing.

On street 22, street traffic light signals 18 are situated, which are situated for the respective travel directions of street 22 on the inflow side of the grade crossing.

Furthermore, FIG. 1 shows barriers in the form of half barriers 28 of the grade crossing in an opened position. The example shown is a fully barriered grade crossing, in which, for each travel direction there is a first, inflow side barrier 28 and a second, outflow side barrier 28' of the grade crossing.

Light signals 18 and barriers 28, 28' are connected to a control unit 29.

Furthermore, FIG. 1 shows a data receiving unit 100 connected to control unit 29 for receiving information on an expected time of the arrival of the next train at the grade crossing.

Figure 2:
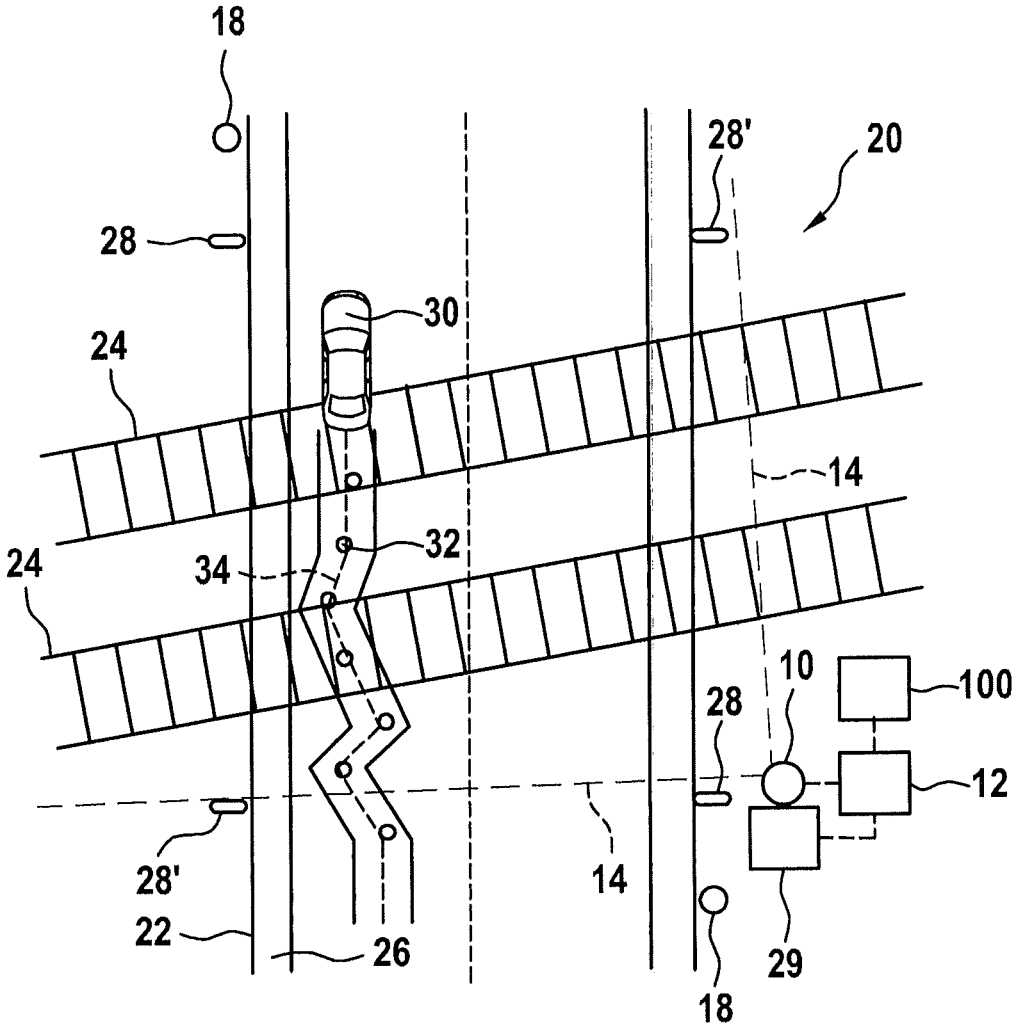
FIG. 2 shows an exemplary representation to explain the ascertainment of an object trajectory.

FIG. 2 shows, by way of an example, a traffic situation having a traffic object 30 detected by radar sensor 10, in the form of a vehicle. On detected object 30, evaluation unit 12 receives data on object position 32 and data on the object speed, particularly the relative speed with respect to stationary radar sensor 10.

An object trajectory 34 is determined from the curve over time of the object positions 32. The object trajectories 34 determined for the individual objects are stored.

With the aid of an accumulation 36 of object trajectories 34, evaluation unit 12 identifies the position of at least one traffic path in the form of a route section. This is explained in more detail below with the aid of FIG. 3.

Figure 3:
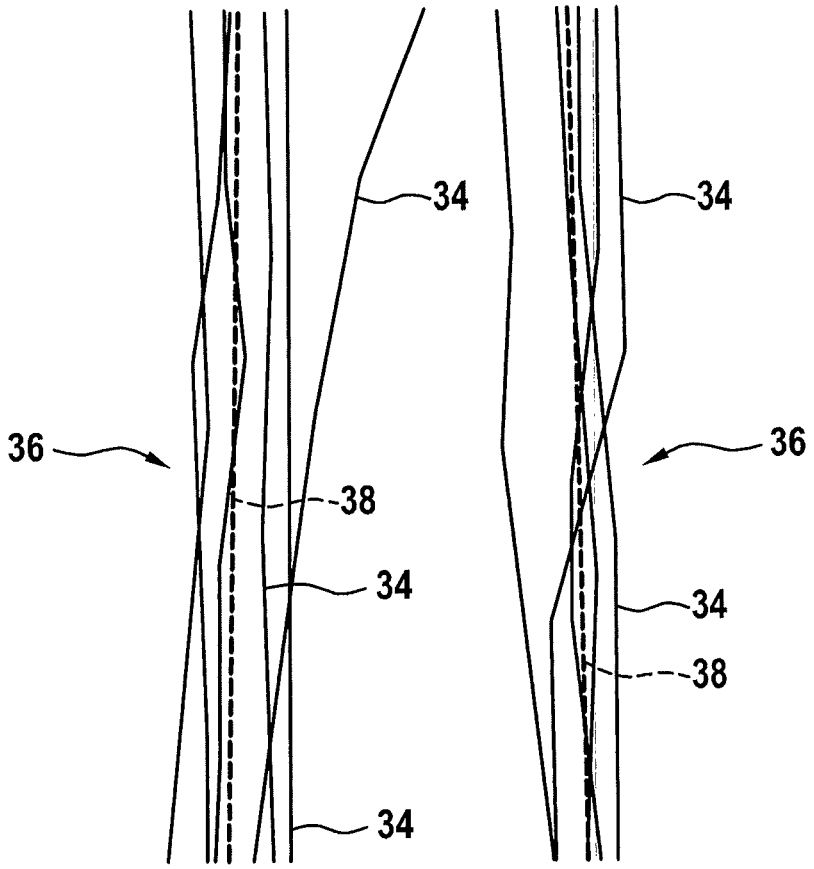
FIG. 3 shows a schematic representation of a characteristic trajectory of an accumulation of trajectories.

FIG. 3 schematically shows accumulations 36 of object trajectories 34 running spatially closely together. The accumulations 36 are determined. From object trajectories 34 determined for a plurality of objects 30, with the aid of their respective similarities, groups of similar or approximately spatially coinciding trajectories 34 are formed, for example. A respective characteristic trajectory 38 is determined on an accumulation 36. It is smoothed optionally or straightened out, and is then determined as the position of a route section. In this context, a traffic direction assigned to the route section may optionally be determined.

For different classes of traffic objects 30, respective route sections may optionally be determined. Evaluation unit 12 may be designed to classify the detected traffic objects 30 into object classes of objects of different size and/or type, with the aid of object reflections associated with the respectively detected traffic objects 30, for example. Passenger cars and persons may be assigned to different object classes, for example. Passenger cars and trucks may be assigned to different object classes, for example. The determination of an object class may be based on a backscatter cross section, an extension in the horizontal direction and/or a height of traffic object 30, for example. Height information may be determined from elevation angle-dependent reflection data of traffic object 30, for example. A horizontal extension may be ascertained, for example, by assigning a plurality of reflection centers to one traffic object 30.

Figure 4:
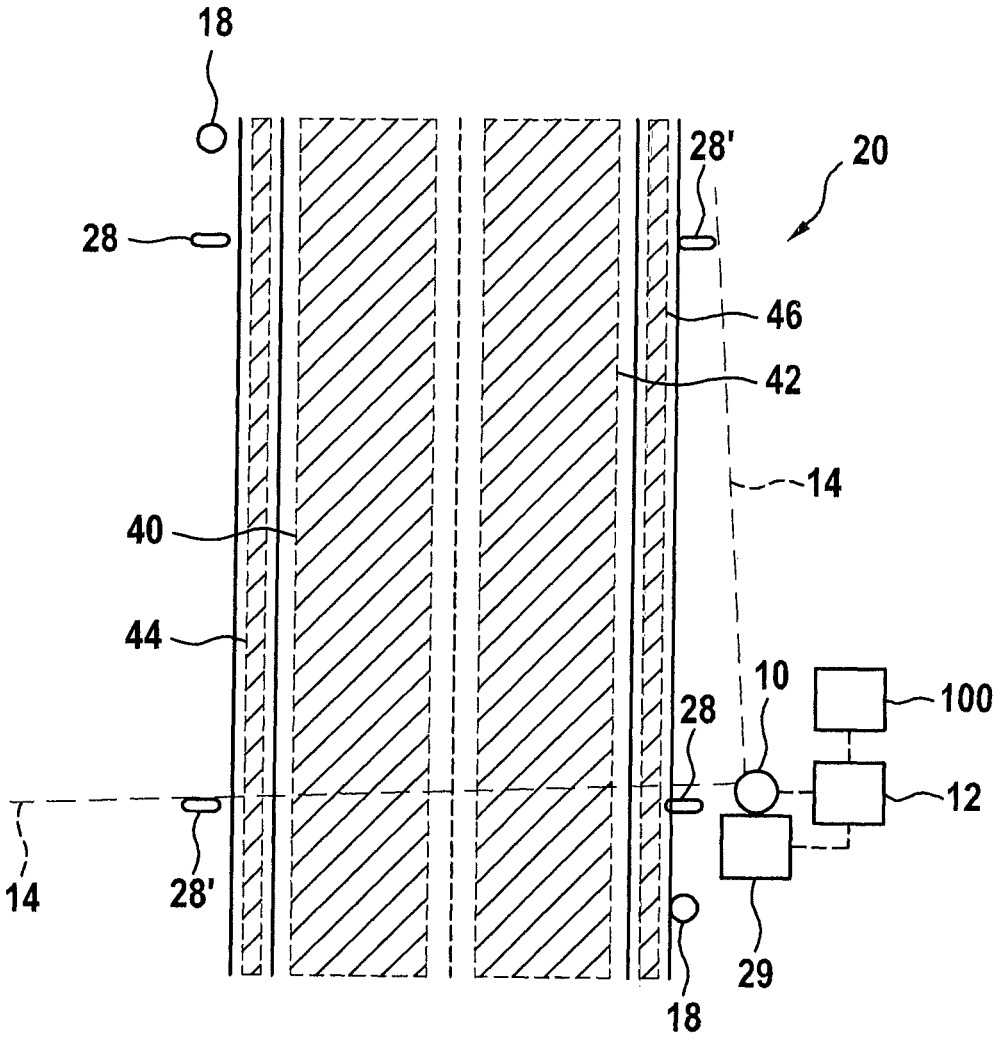
FIG. 4 shows a schematic representation of the traffic lanes identified by the device.

After a learning phase of the device, for instance, the positions of route sections 40, 42 shown schematically in FIG. 4, are stored in evaluation unit 12 in the form of travel lanes, as well as optionally, for instance, route sections 44, 46 in the form of pedestrian paths. The learning phase may be terminated when there is a sufficient data base, or evaluation unit 12 may be set up for a continuous learning, even during operation of the device subsequent to the initial learning phase.

The learning described has the advantage that the setup and the configuration of the device become greatly simplified. Alternatively or in addition to the described determination of route sections 40, 42, 44, 46, evaluation unit 12 may also, however, be preconfigured for respective route sections 40, 42, or the route sections may be established in other ways.

In the operation of the device described below, detected traffic objects 30 may be assigned to the respective route sections 40, 42, and 44, 46, based on the respectively detected object position of traffic objects 30.

As described below, a lead time D is determined for activating light signal 18 that is assigned to the respective route section 40, 42, with the aid of the curve over time of the detected motions of traffic objects 30 assigned to the respective route sections 40, 42.

For each detected traffic object 30, for instance, an instantaneous speed or an average speed along the respective route section 40, 42 is determined.

For the detected traffic objects 30 assigned to a respective route section 40, 42, for instance, one or more of the parameters of the traffic named below may be determined:

Thus, an average speed and/or a minimum speed may be determined on the route section, for example.

For example, a minimum separation distance, an average separation distance or a maximum separation distance of traffic objects 30 following the route section may be determined.

The traffic volume of the traffic flow may be determined, for example, as $p=M/\Delta t$, where M is the number of traffic objects designated, which are detected, in a certain time period $\Delta t$, on the respective route section.

The traffic density may be determined as $d=M/z$, for example. In this case, M is the number of traffic objects which are simultaneously located on route sections of length z.

With the aid of the above parameters, depending on the evaluation model used, an evaluation may take place of the traffic situation on respective traffic sections 40, 42, particularly a classification or rating with respect to the danger of a traffic jam, into one of the classes "free-flowing traffic", "slow-moving traffic" and "traffic jam". In particular, from the object speeds of traffic objects 30 assigned to a respective route section 40, 42 and from the number of simultaneously located traffic objects 30 associated with route section 40, 42, or the distance between the individual traffic objects 30, for instance, a rating of the traffic on route sections 40 and/or 42 may be made with respect to the danger of a traffic jam.

A respective lead time D is assigned to the respective classes of the traffic situation, for example, which in a corresponding traffic situation is usually sufficient, in the case of an activation of light signal 18 that is assigned to respective route sections 40, 42, to permit a flowing off of the traffic, which is no longer detected by light signal 18, from the grade crossing. Lead time D, assigned to the class "traffic jam", is greater than lead time D of class "slow-moving traffic", which, in turn, is greater than lead time D assigned to the class "free-flowing traffic".

A further example for determining lead time D for a respective route section 40, 42 in the form of a traffic lane is explained below.

For example, for detected traffic objects 30 assigned to a respective route section 40, 42, a respective residence time of traffic object 30 in route section 40, 42 is able to be determined. The residence time may be determined directly, for example, or it may be calculated from an ascertained speed of traffic object 30 and a known length or route section 40, 42.

From the respective residence times of traffic objects 30, for example, a flow-off time T1 or T2 for respective route section 40, 42 may be determined, within which, after an activation of the associated light signal 18, usually the traffic, no longer covered by light signal 18, of the corresponding route section 40, 42, flows off.

Flow-off time T1, T2 may, for instance, also be determined with the aid of the abovementioned parameters, such as average speed and/or minimum speed of traffic objects 30 on a route section 40, 42, again, taking into account a length of route section 40, 42.

Determined flow-off time T1, T2, optionally with the addition of a safety factor, may then be set as lead time D for respective route section 40, 42.

Evaluation unit 12 receives information of the expected time T0 of the arrival of the next train at the grade crossing, from data receiving unit 100. Based on the determined lead time D for respective route section 40, 42, and based on expected time T0 of the arrival of the train, evaluation unit 12 emits a control signal S to control unit 29, which is on time to the extent that ordinarily the traffic that is present is able to flow off from respective route section 40, 42, still in time before the arrival of the train. For instance, evaluation unit 12 compares the expected time of arrival of the train in the form of a relative time or a time duration T0 to a fixed minimum lead time TR, as well as to determined lead time D. If minimum lead time TR or determined lead time D is greater than or equal to relative time T0, evaluation unit 12 emits a control signal S to activate corresponding light signal 18 to control unit 29. The latter thereupon activates light signal 18, for example.

Figure 5:
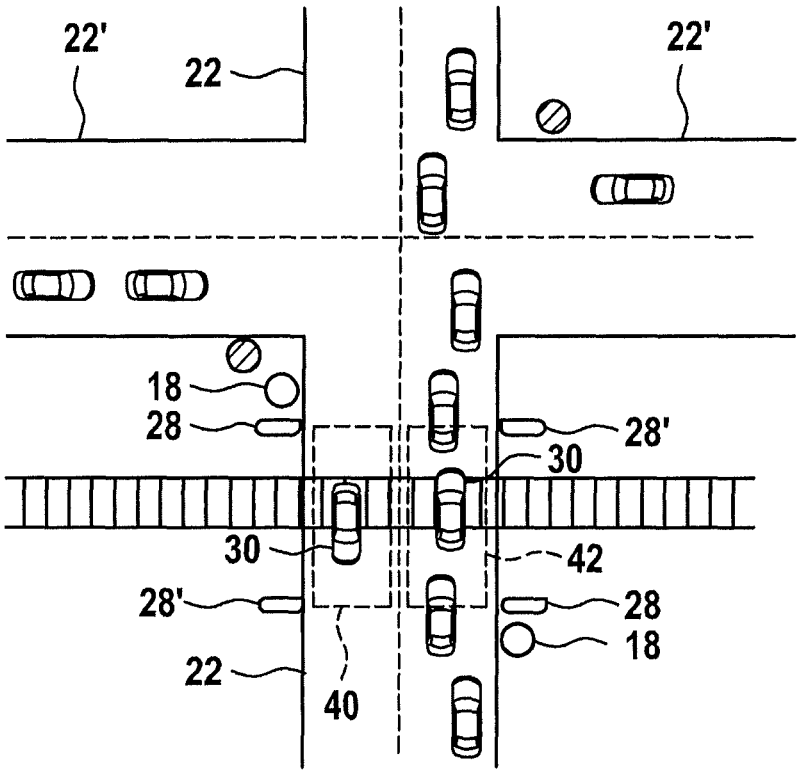
FIG. 5 shows a schematic representation of a traffic jam situation at the grade crossing.

In exemplary fashion, FIG. 5 shows a traffic situation having a traffic jam on a route section 42 and unimpeded, free-flowing traffic on a route section 40, in the opposite direction. Light signals 18, which are situated on respective route section 40, 42 on the inflow side of the grade crossing, have not been activated yet, i.e. they are switched off or switched to green. For route section 40, a relatively short lead time D is determined, which is, for instance, equal to an expected flow-off time T1 with the addition of a safety factor m. For route section 42, a relatively long lead time D is determined, which is, for instance, equal to the determined flow-off time T2 with the addition of a safety factor m.

Figure 6:
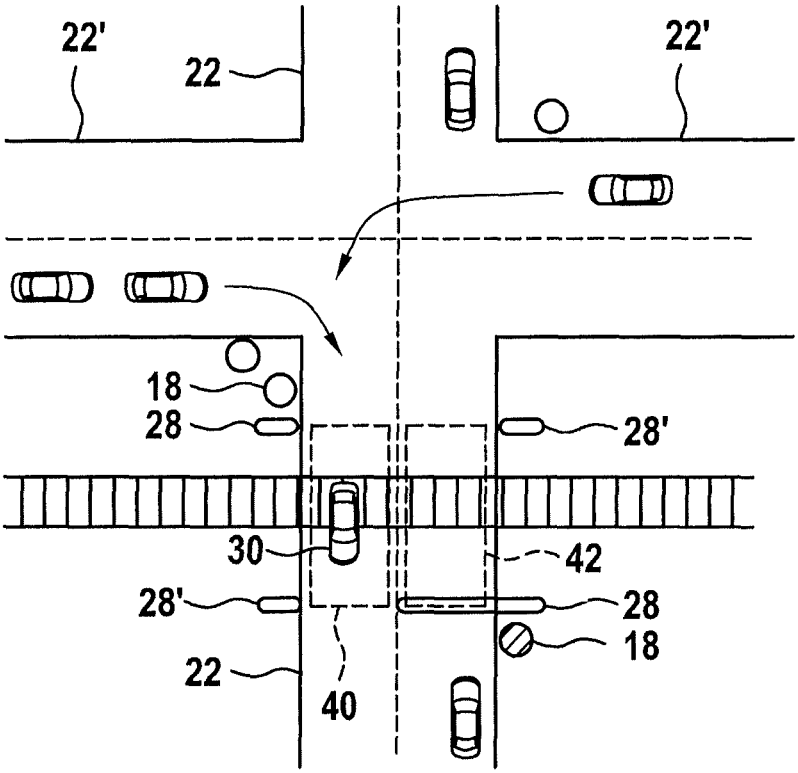
FIG. 6 shows a schematic representation of a traffic situation to explain the present invention.
Figure 8:
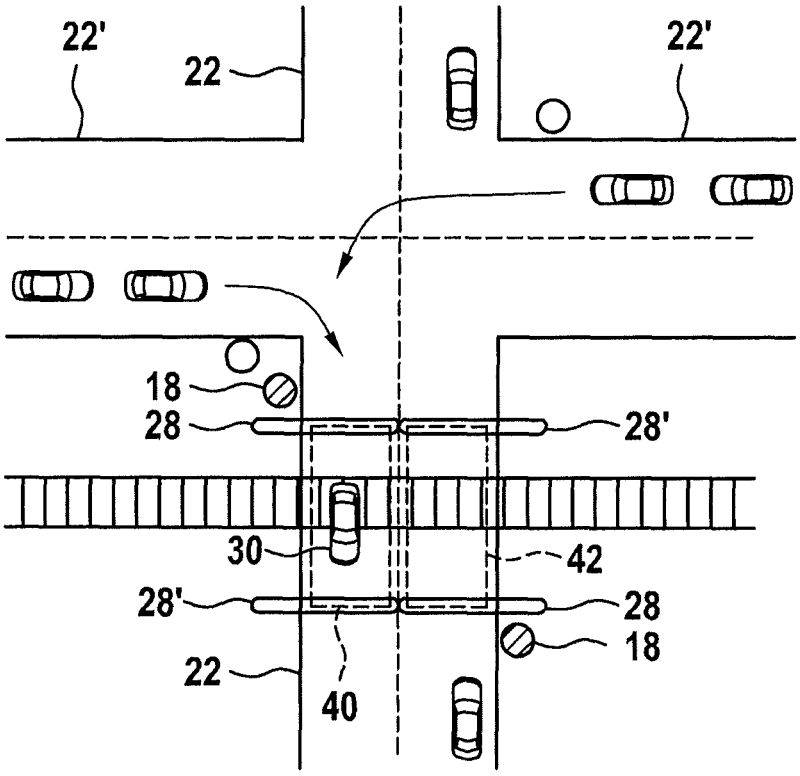
FIG. 8 shows a schematic representation of a traffic situation of an exemplary comparison.

In FIG. 5, FIG. 6 and FIG. 8, the activated light signals 18, or rather the light signals 18 switched to red, are each shown hatched.

FIG. 6 shows a traffic situation at the approach of a train that is expected within lead time D of route section 42. Assigned light signal 18 is accordingly activated, i.e. switched to red. In a corresponding manner, for instance, based on a correspondingly determined lead time for the actuation of barrier 28, the barrier 28 which is situated on the inflow side of the grade crossing assigned to route section 42 is closed by a corresponding actuation by control unit 29.

The other light signal 18 as well as barrier 28 on the inflow side, which are assigned to other route section 40 in the opposite direction, correspondingly to shorter lead time D, are activated only at a later point in time. Thereby the traffic on route section 40 is able to continue to flow. For example, an unnecessary backup, on a street 22', which borders the grade crossing and which opens out on the inflow side into street 22 and which crosses the grade crossing is able to be avoided.

Figure 7:
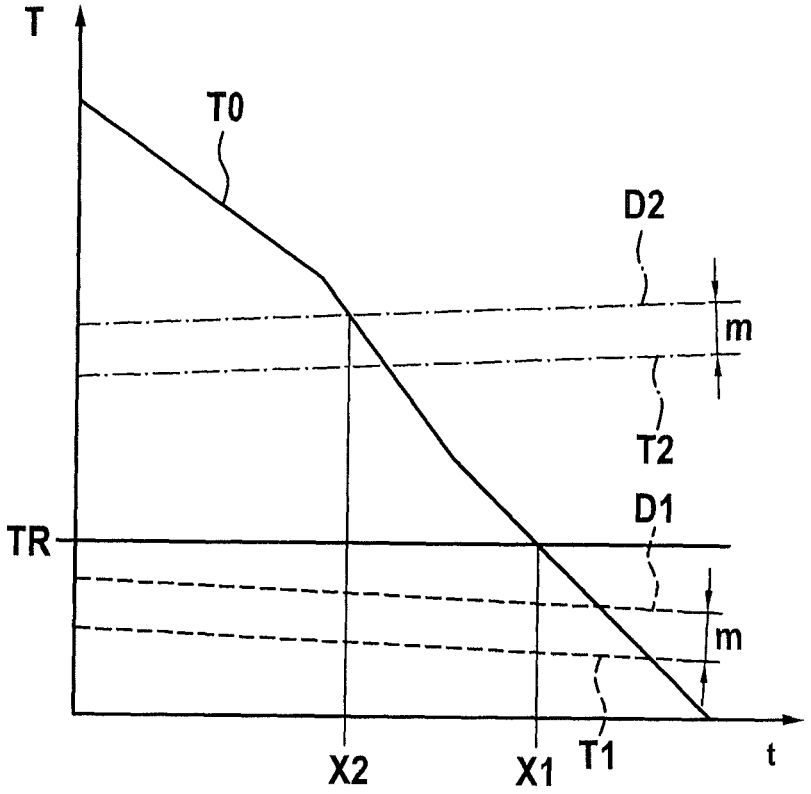
FIG. 7 shows a schematic diagram for explaining the determination of a point in time for activating a light signal.

FIG. 7 shows schematically, in a diagram over time t, the repeatedly updated relative point in time T0 for the expected arrival of the train. Also plotted, as a constant value, is fixed minimum lead time TR for switching light signal 18.

A dashed line shows, for route section 40, the associated, repeatedly updated lead time D1 which, for example, corresponds to determined flow-off time T1 with the addition of a safety factor m. In the example shown, this lead time D1 is always below minimum lead time TR, and even decreases some more in the curve over time. Light signal 18, assigned to route section 40, is therefore activated at time X1, at which the expected time of arrival T0 is equal to minimum lead time TR.

Using a dash-dotted line, FIG. 7 shows the repeatedly updated lead time D2, which is assigned to route section 42. This line, in turn, corresponds to determined flow-off time T2 with the addition of safety factor m. Based on the traffic jam situation, lead time D2 is greater here than minimum lead time TR. At a time X2, at which expected arrival time T0 is equal to lead time D2, light signal 18, assigned to route section 42, is activated.

Time X2 is clearly earlier than time X1, since, based on the traffic jam situation, in this case, a greater lead time is required for the flowing off of the traffic.

FIG. 8 shows, as an exemplary comparison, a traffic situation at a conventional, traffic-independent activation of the light signals and barriers. Because of the very early activation of all light signals, route section 40, that is freely moving per se, is also blocked early, so that a backup may take place, for example, on street 22'.

Because of the device described and the working method of the device described, the traffic flow at the grade crossing is able to be optimized accurately to each lane i.e. for each travel direction individually. In addition, lock-ins of vehicles in the case of a fully barriered grade crossing are able to be avoided better. By specific, traffic-dependent switching of the inflow side light signals at the grade crossing, if possible, instead of full barriers, a grade crossing having half barriers may be so equipped, in each case only on the inflow side.

The use of a radar sensor unit has the particular advantage that it works independently of weather conditions, and makes speed measurement possible; in addition, the radar sensor device is able to do without movable parts.

Whereas in the above example, the determination of a lead time D for a respective route section 40 or 42 for the output of a control signal for the associated light signal 18 was explained in detail, evaluation unit 12 may be set up in a corresponding manner to output a lead time D for the output of a control signal for a barrier 28 on the inflow side or for a barrier 28' on the outflow side. It is also conceivable, however, to switch barriers 28 and/or 28' simultaneously with or at an established respective distance over time, following the activation of light signals 18.

The traffic on further route sections, such pedestrian paths 44, 46 or bicycle paths may be included in the determination of a respective lead time D or may be taken into account by determining a suitable minimum lead time TR.

Street traffic area 20 monitored by the radar sensor device may, for example, include the danger zone of the grade crossing or a part of the danger zone.

What is claimed is:

1. A device for a traffic-dependent control of at least one of a barrier and a traffic light signal situated on an inflow side of a grade crossing, comprising:

a radar sensor device configured to detect motions of traffic objects over a street traffic area of the grade crossing; and an evaluation unit having a processor configured to:

determine a desired lead time before an expected time of arrival of a train at the grade crossing, with the aid of a curve over time of the detected motions of the traffic objects, wherein the lead time is increased as traffic speed is decreased; and emit a control signal to a control unit for at least one of the barrier and the traffic light signal situated on the inflow side of the grade crossing, using the determined lead time before an expected time of arrival of a train at the grade crossing.

2. The device as recited in claim 1, wherein the radar sensor device includes an FMCW radar sensor, which is configured to determine an object position and an object speed of a detected object.

3. The device as recited in claim 2, wherein the evaluation unit is configured to determine an expected flow-off time of the traffic of the traffic objects on a route section, with the aid of the curve over time of the detected motions of the traffic objects, and to determine the lead time with the aid of the expected flow-off time.

4. The device as recited in claim 3, wherein the lead time in the case of an expected flow-off time which corresponds to a slow-moving traffic is greater than for an expected flow-off time which corresponds to a more rapidly flowing traffic.

5. The device as recited in claim 3, wherein the evaluation unit is configured to determine the lead time with the aid of the curve over time of the detected motions of the traffic objects and with the aid of a predefined minimum lead time.

6. The device as recited in claim 3, wherein the evaluation unit is configured to (i) determine an expected flow-off time of the traffic of the traffic objects on a route section, with the aid of the curve over time of the detected motions of the traffic objects, and (ii) determine the lead time as the maximum of the expected flow-off time and a predefined minimum lead time.

7. The device as recited in claim 3, wherein the evaluation unit is configured to (i) evaluate, based on detected object speeds of a plurality of objects assigned to a given route section, a traffic situation associated with the given route section with respect to the danger of a traffic jam, wherein the danger of a traffic jam is classified into one of at least three classes, and (ii) determine the lead time of the given route section with the aid of the evaluated danger of a traffic jam.

8. The device as recited in claim 3, wherein the evaluation unit is configured to (i) ascertain object trajectories from sequences in time of object positions of respective traffic objects which are detected by the radar sensor device and moving on the street traffic area, (ii) identify the position of at least one route section with the aid of an accumulation of object trajectories, and (iii) assign to the at least one route section further detected traffic objects.

9. The device as recited in claim 3, wherein the evaluation unit is configured to (i) emit, for each route section having a different travel direction, one control signal to at least one of a barrier assigned to the travel direction and a street traffic light signal situated on the inflow side of the grade crossing with respect to the respective travel direction, using a predefined standard lead time of the arrival of a train at the grade crossing, and to (ii) determine an adjusted lead time with the aid of the curve over time of the detected motions of the objects assigned to the respective route section.

10. The device as recited in claim 3, wherein the radar sensor device includes at least one wide-angle radar sensor having a stationary antenna system, whose field of view includes an azimuth angle range of at least 90°.

11. A method for the traffic-dependent output of a control signal for at least one of a barrier and a light signal at a grade crossing, the method comprising:

detecting motions of traffic objects over a street traffic area, by at least one radar sensor device situated in stationary manner with respect to the street traffic area;

determining a lead time before an expected time of arrival of a train at the grade crossing, with the aid of the curve over time of the detected motions of the traffic objects over the street traffic area, wherein the lead time is increased as traffic speed is decreased; and emitting a control signal to a control unit for at least one of the barrier and the traffic light signal situated on the inflow side of the grade crossing, using the determined lead time before an expected time of the arrival of a train at the grade crossing.

12. A method for controlling at least one of a barrier and a light signal at an inflow side of an area of a grade crossing, the method comprising:

obtaining a characterization of motion of vehicles at the grade crossing based on sensor data;

based on the characterization of the motion of vehicles, estimating an amount of time needed for a vehicle to exit the area of the grade crossing at an outflow side of the area after entering the area of the grade crossing from the inflow side of the area;

in a case where a time between a present time and an expected train arrival time is at least as long as the estimated amount of time, setting a lead time, preceding the expected train arrival time, at which to activate the at least one of the barrier and the light signal at the inflow side of the area, wherein the setting of the lead time is performed based on the estimated amount of time according to a condition that an amount of time between the lead time and the expected train arrival time is at least as long as the estimated amount of time; and controlling the activation of the at least one of the barrier and the light signal at the inflow side of the area based on the set lead time.

* * * * *